United States Patent [19]

Shingu et al.

[11] Patent Number: 4,469,512

[45] Date of Patent: Sep. 4, 1984

[54] PROCESS FOR PRODUCING HIGH-PURITY ALUMINUM

[75] Inventors: Hideo Shingu, Kyoto; Kozo Arai, Osaka; Masashi Sakaguchi, Osaka; Toshio Nishide, Osaka; Osamu Watanabe, Osaka; Yasushi Tashiro, Osaka; Ryotatsu Otsuka, Osaka; Kenji Tsukamoto, Osaka, all of Japan

[73] Assignee: Showa Aluminum Corporation, Osaka, Japan

[21] Appl. No.: 403,023

[22] Filed: Jul. 29, 1982

[51] Int. Cl.[3] ..... C22B 23/06

[52] U.S. Cl. ..... 75/63; 75/68 R

[58] Field of Search ..... 75/68 R, 63

[56] References Cited

U.S. PATENT DOCUMENTS 3,198,625 8/1965 Stroup ..... 75/63
3,211,547 10/1965 Jarrett et al. ..... 75/68 R
3,239,899 3/1966 Johnson ..... 75/68 R
3,543,531 12/1970 Adams ..... 75/63
3,671,229 6/1972 Ferber et al. ..... 75/68 R

*Primary Examiner*—M. J. Andrews
*Attorney, Agent, or Firm*—Armstrong, Nikaido, Marmelstein & Kubovcik

[57] ABSTRACT

To obtain a high-purity aluminum fraction from aluminum containing both eutectic impurities and peritectic impurities, the contents of these impurities in the original aluminum are reduced by melting the original aluminum to obtain molten aluminum, adding boron to the molten aluminum, and rotating a cooling body as immersed in the boron-containing molten aluminum while introducing a cooling fluid to the interior of the body to crystallize high-purity aluminum on the surface of the body. The peritectic impurities react with the boron to form metallic borides, which are centrifugally forced away from the cooling body by the rotation of the body without being incorporated into the aluminum crystallized on the surface of the body. The eutectic impurities are removed from the crystallized aluminum on the surface based on the principle of segregation.

8 Claims, 5 Drawing Figures

11
12
13
14
15
16
17
18
19
20
21
22
23
24
30

AV. IMPURITY CONCN. OF Al YIELD
NUMBER OF TANKS
0
4
8
12

C4/Co
C3/Co
C2/Co
C1/Co
CN/Co
1.0
YIELD (kg)
0
100
200
300
400

PROCESS FOR PRODUCING HIGH-PURITY ALUMINUM

BACKGROUND OF THE INVENTION

The present invention relates to a process for producing aluminum having high purity, and more particularly to a process for treating aluminum containing eutectic impurities, such as Fe, Si Cu and Mg, and also peritectic impurities, such as Ti, V and Zr, by resorting to segregation solidification to obtain aluminum having lower contents of eutectic impurities and peritectic impurities and a higher purity than the original aluminum.

Throughout the specification and the appended claims, the term "eutectic impurities" refers to the impurities which undergo a eutectic reaction with aluminum, and the term "peritectic impurities" refers to the impurities which undergo a peritectic reaction with aluminum.

When aluminum containing both eutectic impurities and peritectic impurities is melted and then subjected to equilibrium solidifcation, the impurity concentration Cs of the resulting solid aluminum fraction is theoretically represented by the following equation.

$$Cs = koCo(1-fs)^{ko-1} \quad (1)$$

wherein ko is the distribution coefficient, Co is the impurity concentration of the original aluminum, and fs is the ratio of the solid fraction. The above equation shows that when the distribution coefficient ko is smaller than 1, the impurity concentration Cs of the solid fraction is smaller than the impurity concentration Co of the original aluminum and that when the distribution coefficient ko is larger than 1, the impurity concentration Cs of the solid fraction is greater than the impurity concentration Co of the original aluminum. Since eutectic impurities are smaller than 1 in distribution coefficient, the solid fraction prepared from aluminum containing such impurities is lower than the original aluminum in impurity concentration. Accordingly when the original aluminum is melted and thereafter solidified, high-purity aluminum can be obtained advantageously by selectively separating off the resulting pro-eutectic aluminum. Segregation solidification processes based on this principle are already known as disclosed, for example, in U.S. Pat. No. 3,671,229, No. 3,211,547, etc. However, peritectic impurities are larger than 1 in distribution coefficient, so that aluminum containing such impurities affords a solid fraction which is higher than the original aluminum in impurity concentration. Accordingly when aluminum containing both eutectic impurities and peritectic impurities is treated by the conventional segregation solidification process to obtain pro-eutectic aluminum selectively, the resulting solid fraction is lower in the concentration of eutectic impurities but higher in the concentration of peritectic impurities than the original aluminum.

Aluminum containing both eutectic impurities and peritectic impurities is therefore usually treated by adding boron to a melt of such aluminum in a container to cause the boron to react with Ti, V, Zr and like peritectice impurities and form insoluble metallic borides such as $TiB_2$, $VB_2$, $ZrB_2$, etc., allowing the mixture to stand for a long period of time, for example, for more than 1 hour to settle the metallic borides, placing the molten aluminum into another container as separated from the borides, and selectively drawing off pro-eutectic aluminum only from the container. This process is inefficient since the settlement of the metallic borides requires much time.

SUMMARY OF THE INVENTION

The object of the present invention is to overcome the above drawback and to provide a process for treating aluminum containing both eutectic impurities and peritectic impurities by segregation solidification to remove the impurities of both types from the aluminum to the greatest possible extent and obtain aluminum having a higher purity than the original aluminum.

The process of this invention for producing high-purity aluminum comprises the steps of melting aluminum containing both eutectic impurities and peritectic impurities to obtain molten aluminum, adding boron to the molten aluminum, immersing a cooling body into the boron-containing molten aluminum, and rotating the cooling body while introducing a cooling fluid to the interior of the cooling body to crystallize high-purity aluminum on the surface of the body.

With this process, the boron reacts with the peritectic impurities to form metallic borides, which are moved away from the cooling body and dispersed throughout the liquid phase by the centrifugal force produced by the rotation of the cooling body. Accordingly an aluminum fraction having lower contents of eutectic impurities and peritectic impurities than the original aluminum can be crystallized on the surface of the cooling body, giving high-purity aluminum. Unlike the conventional process, the present process does not involve the necessity of settling the metallic borides and therefore can be practiced within a shortened period of time.

When aluminum containing Fe, Si, Cu, Mg and like eutectic impurities, and Ti, V, Zr and like peritectic impurities is melted, and boron is added to the resulting melt, the boron reacts with the Ti, V, Zr and like peritectic impurities to form $TiB_2$, $VB_2$, $ZrB_2$ and like insoluble metallic borides. The amount of boron to be used, which is determined in accordance with the Ti, V, Zr and like contents of the aluminum to be purified, is a predetermined amount larger than the amount needed for forming the above metallic borides. The boron may be added in the form of an Al-B master alloy or $NaBF_4$ or like salt. Since boron undergoes a eutectic reaction with aluminum, the excess of boron other than the quantity of boron forming the metallic borides with the peritectic impurities is removed in the same manner as the eutectic impurities as will be described below.

When a cooling body is rotated as immersed in the boron-containing molten aluminum while introducing a cooling fluid to the interior of the body, high-purity aluminum crystallizes on the surface of the cooling body. Stated more specifically, when aluminum containing eutectic impurities is melted and subjected to equilibrium solidification, pro-eutectic aluminum of high purity separates out first. The ratio between the eutectic impurity concentration of the solid phase and the eutectic impurity concentration of the liquid phase at this time is represented by the distribution coefficient ko. During actual solidification, however, the eutectic impurities are released into the liquid phase to form a layer of concentrated eutectic impurities in the liquid phase in the vicinity of the liquid-solid interface or boundary, so that the impurity concentration of the solid phase is governed by the effective distribution coefficient $k_E$ considering the thickness of the concentrated layer (hereinafter referred to as "diffusion layer"). Thus the impurity concentration Cs of the solid phase is represented by Equation (1) wherein $k_E$ is used in place of ko, i.e. by the following equation.

$$Cs = k_E Co(1-fs)^{k_E-1} \quad (2)$$

It is already known that the effective distribution coefficient $k_E$ is represented by the following equation, $$k_E = \frac{ko}{ko + (1 - ko)\exp\left(-\frac{R\delta}{D}\right)}$$

wherein R is the solidification velocity, δ is the thickness of the diffusion layer formed in the vicinity of the liquid-solid interface, and D is the diffusion coefficient of the eutectic impurities in the liquid phase. It therefore follows that the effective distribution coefficient $k_E$ can be made approximate to the distribution coefficient ko effectively by decreasing the solidification velocity R and the thickness of the diffusion layer, δ, and increasing the diffusion coefficient D. Of these variables, the diffusion coefficient D is considered to be a constant which is dependent on the kind of the eutectic impurity generally when the liquid phase has a constant temperature, so that it is difficult to vary the diffusion coefficient D. It is therefore effective to decrease the solidification velocity R and the thickness of the diffusion layer, δ, for making the effective distribution coefficient $k_E$ approximate to the distribution coefficient ko.

When the eutectic impurities are released into the liquid phase at the liquid-solid interface, dendrites are formed at the interface. It is well known that when such dendrites grow, the impurities released into the liquid phase in the vicinity of the liquid-solid interface are trapped, as they are or in the form of eutectic crystals of several microns, in the interstices of the dendrites. This phenomenon is undesirable for the purification of aluminum. The growth of dendrites occurs when the actual temperature of the liquid phase is lower than the temperature of the equilibrium liquidus in the vicinity of the liquid-solid interface. This phenomenon is referred to as constitutional undercooling. The growth of dendrites is promoted when the difference (degree of undercooling) ΔT between the temperature of the equilibrium liquidus and the actual liquid phase temperature increases. Accordingly the growth of dendrites can be inhibited effectively by decreasing the difference ΔT. To decrease ΔT, there is the need to increase the temperature gradient of the melt in the vicinity of the liquid-solid interface. Ideally, the temperature gradient should be smaller than the temperature gradient of the equilibrium liquidus to make ΔT smaller than 0.

The foregoing leads to the following three requirements for purifying aluminum with improved efficiency.

(a) To decrease the solidification velocity to the greatest possible extent.

(b) To decrease to the greatest possible extent the thickness of the diffusion layer in the vicinity of the liquid-solid interface.

(c) To increase to the greatest possible extent the temperature gradient involved in the liquid phase in the vicinity of the interface.

When a cooling body is immersed in molten aluminum containing boron, aluminum having a high purity starts to crystallize on the surface of the cooling body. The solidification proceeds while the eutectic impurities are being released into the liquid phase in the vicinity of the liquid-solid interface to form a diffusion layer. The solidification velocity at this time is governed by the difference between the amount of heat removed from the molten aluminum by the cooling body and the amount of heat supplied to the molten aluminum by heating from outside. Thus the velocity is controlled by these amounts of heat. Further when an increased amount of heat is supplied to the molten aluminum by external heating, with an increased amount of heat removed from the melt by cooling with the cooling body, greater transfer of heat occurs between the cooling body and the melt, consequently giving a greater temperature gradient to the liquid phase in the vicinity of the liquid-solid interface. The greater the temperature gradient, the more effectively is the formation of dendrites inhibited at the interface to prevent the eutectic impurities from being arrested by the dendrites. Ideally, the temperature gradient involved in the liquid phase in the vicinity of the liquid-solid interface should be greater than that of the equilibrium liquidus. The formation of dendrites can then be inhibited completely. From the viewpoint of industrial productivity, however, it is desirable to effect suitable transfer of heat from the molten aluminum to the cooling body by advantageously controlling the external heating and cooling with the cooling body. Further when the cooling body is rotated, the solid phase and the liquid phase move relative to each other, whereby the diffusion layer formed near the liquid-solid interface is effectively agitated and mixed with the other major portion of the liquid phase to disperse the impurities in the diffusion layer throughout the entire liquid phase, consequently greatly reducing the thickness of the diffusion layer. At the same time, the boundary layer in the temperature distribution of the liquid phase is made thinner, consequently permitting the liquid phase to have an increased temperature gradient in the vicinity of the liquid-solid interface. The thickness of the diffusion layer and the boundary layer in the temperature distribution can be decreased by increasing the speed of rotation of the cooling body, in other words, the speed of the relative movement between the cooling body and the molten aluminum. However, if the speed is exceedingly high, the aluminum crystallized on the surface of the cooling body is likely to separate off easily due to the increase of the centrifugal force, resulting in reduced productivity. Preferably the speed of the relative movement is within the range of 400 to 8000 mm/sec because if the speed is lower than 400 mm/sec, the diffusion layer will not be made thinner effectively, whereas if it is higher than 8000 mm/sec, the increased centrifugal force will lead to reduced productivity. When the cooling body is in the form of a cylinder having a diameter of 160 mm, for example, the body can be rotated at 50 to 1000 r.p.m., but especially good results are obtained at 200 to 700 r.p.m. Further improved results can be achieved if the direction of rotation of the body is reversed with suitable frequency. Since boron undergoes a eutectic reaction with aluminum, the excess of boron other than the amount of boron forming metallic borides with the peritectic impurities is removed in the same manner as Fe, Si, Cu, Mg and like eutectic impurities.

The high-purity aluminum deposited on the surface of the cooling body on crystallization is recovered, for example, by melting the high-purity fraction or by scraping off the fraction.

The present invention further provides a process comprising the steps of melting aluminum containing both eutectic impurities and peritectic impurities to obtain molten aluminum, placing the molten aluminum into a holding container, adding boron to the molten aluminum within the container, and rotating a cooling body as immersed in the boron-containing molten aluminum within the container while introducing a cooling fluid to the interior of the cooling body to crystallize high-purity aluminum on the surface of the body.

In the above process, the cooling body is immersed into the molten aluminum preferably after causing the boron to react with the peritectic impurities by allowing the molten aluminum to stand for at least about 5 minutes following the addition of the boron. To promote the reaction, it is desirable to agitate the boron-containing molten aluminum.

The present invention further provides a process comprising melting aluminum containing both eutectic impurities and peritectic impurities to obtain molten aluminum, placing the molten aluminum into a boron adding vessel, causing the molten aluminum placed into the vessel to be forwarded to a plurality of purifying tanks from tank to tank and to be discharged from the last tank, adding boron to the molten aluminum within the vessel, and rotating a cooling body as immersed in the boron-containing molten aluminum within each of the tanks while introducing a cooling fluid to the interior of the cooling body to crystallize high-purity aluminum on the surface of the body. This process affords a large quantity of high-purity aluminum efficiently by a continuous operation.

The boron adding vessel and the purifying tanks are prepared, for example, by dividing a single large container into a plurality of sections by partitions each having a communication opening, one of the sections serving as the vessel and the other sections as the tanks. Alternatively a plurality of crucibles may be arranged in a row, with each crucible communicating with another through a trough, such that one of the crucibles serves as the boron adding vessel and the others as the purifying tanks.

Boron is placed into the vessel continuously so that the molten aluminum therein has a constant boron concentration during operation. Preferably the molten aluminum in the vessel is agitated to accelerate the reaction between the boron and the peritectic impurities. The cooling body is immersed in the molten aluminum in each of the purifying tanks. The supply of the melt to the purifying tanks is so adjusted that the amount of the melt in each tank remains unchanged during operation. To allow equal amounts of aluminum to crystalize on the surfaces of the cooling bodies in the purifying tanks, the temperature of the molten aluminum, the speed of rotation and cooling capacity of the cooling bodies are suitably controlled. The eutectic impurity concentration of the molten aluminum in the purifying tanks progressively increases from tank to tank away from the melting furnace. The average impurity concentration of all the aluminum fractions obtained is variable by varying the ratio of the total amount of aluminum fractions recovered by the cooling bodies to the total amount of the melt supplied. (The ratio will be referred to as "recovery ratio".) The smaller the recovery ratio, the lower is the average impurity concentration. Accordingly aluminum having a constant purity which is higher than the purity of the original aluminum supplied from the melting furnace for purification can be obtained by rendering the recovery ratio constant. Further at the same recovery ratio, the purity of the aluminum obtained increases with the increase in the number of purifying tanks.

The invention will be described below in greater detail with reference to the accompanying drawings.

DESCRIPTION OF THE PREFERRED EMBODIMENTS

Figure 3:
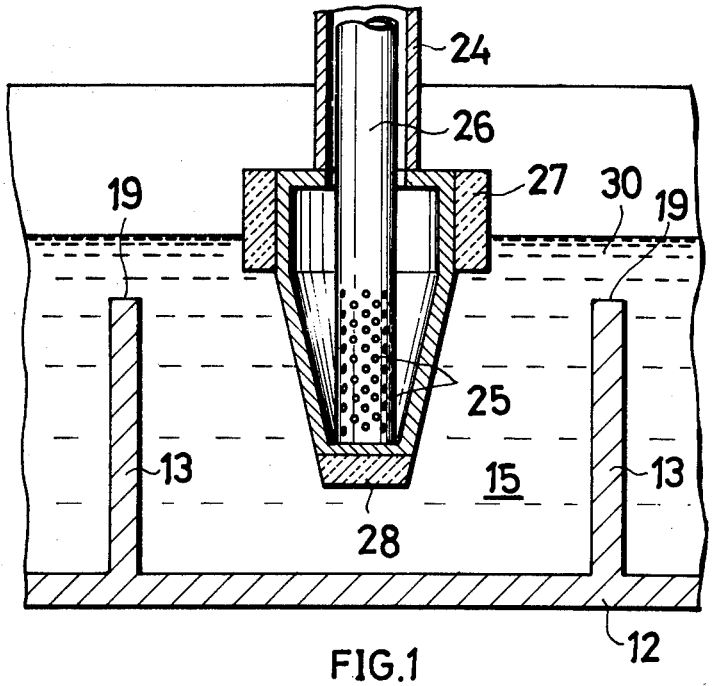
FIG. 3 is an enlarged fragmentary view of FIG. 2 partly broken away.

With reference to a first apparatus for practicing the process of the invention, the aluminum to be purifyied and containing both eutectic impurities and peritectic impurities is melted and placed in a holding container comprising a crucible 2. The molten aluminum 1 is heated and maintained at a temperature exceeding the solidifying temperature thereof. Boron is added to the molten aluminum 1, and the mixture is agitated for at least 5 minutes. A cooling body 3 is thereafter immersed in the melt 1. The cooling body 3 is in the form of a hollow cylinder having closed opposite ends and is movable upward and downward. A hollow rotary shaft 4 extends upward from the upper end of the body 3. The interior of the hollow rotary shaft 4 is in communication with the interior of the cooling body 3. A cooling fluid supply pipe 5 extends through the shaft 4 into the cooling body 3. The rotary shaft 4 is provided at its upper end with a drive device (not shown), by which the shaft 4 and the body 3 are rotated. The top and bottom of the body 3 and the portion of the shaft 4 to be exposed to the melt 1 are preferably covered with a heat insulating material 6 so as not to permit aluminum to crystallize on these portions. This is due to the reason that since the effect produced by the rotation of the body 3 is lower at these portions than at the periphery of the body 3, aluminum, if crystallizing on these portion, will have a lower purity than the aluminum crystallizing on the periphery. The cooling body 3 is rotated while introducing a cooling fluid, such as air, nitrogen or argon, from the pipe 5 into the body 3 at an adjusted rate so that the portion of the melt 1 around the body 3 will be cooled slowly. Pro-eutectic aluminum having a high purity then starts to crystallize on the periphery of the body 3. After a specified quantity of aluminum has been deposited on the body 3, the body is raised and withdrawn from the melt 1, and the high-purity aluminum obtained is collected.

The above procedure is repeated in aluminum melts of progressively higher purities to obtain aluminum of greatly improved purity.

Figure 2:
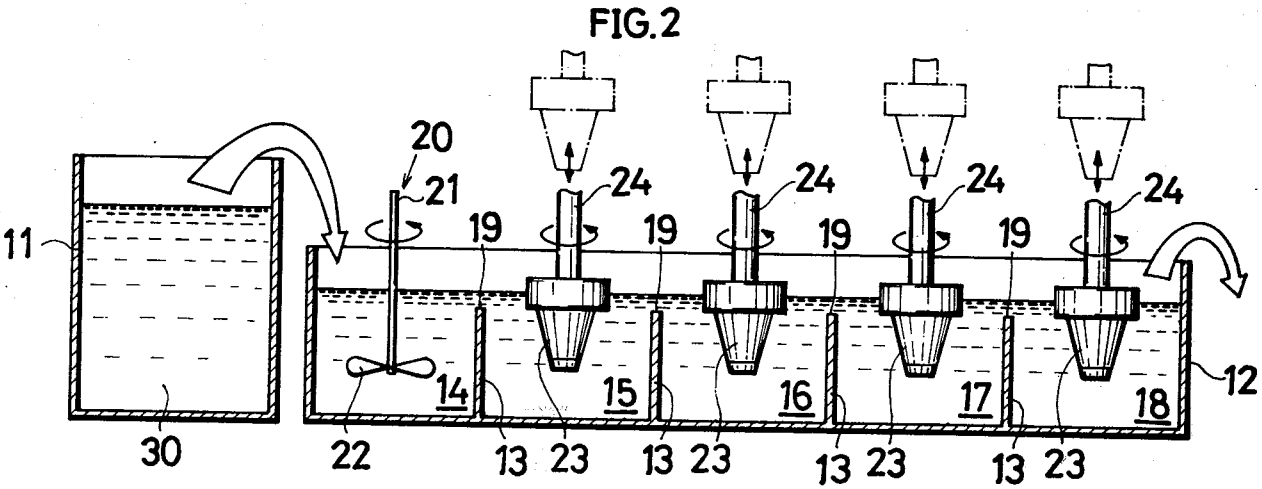
FIG. 2 is a view in vertical section showing a second embodiment of apparatus for producing high-purity aluminum by the process of the invention.

With reference to FIGS. 2 and 3 showing a second apparatus, there is provided a melting furnace 11 for melting the aluminum to be purified and containing both eutectic impurities and peritectic impurities. A large container 12 in the form of a horizontally elongated rectangular parallelepiped is disposed on the right side of the furnace 11. The container 12 is divided into five sections by partitions 13. Of these sections, the one at the left end serves as a boron adding vessel 14, and the other four sections serve as purifying tanks 15 to 18. The partitions 13 are formed at their upper ends with openings 19 through which the vessel 14 and the tanks 15 to 18 communicate with one another. The vessel 14 has an agitator 20 in its interior. The agitator 20 comprises a vertical rotary shaft 21, a propeller-shaped stirring blade 22 attached to the lower end of the shaft 21 and unillustrated drive means. Each of the tanks 15 to 18 is provided with a cooling body 23 which is movable upward and downward. The body 23 is in the form of a downwardly tapered hollow cylinder having closed opposite ends and a hollow rotary shaft 24 extending upward from its top. The interior of the shaft 24 is in communication with the interior of the body 23. A cooling fluid supply pipe 26 extending through the shaft 24 into the body 23 has a large number of cooling fluid outlets 25 in its peripheral wall. The upper end peripheral portion and the bottom of the cooling body 23 are covered with heat insulating members 27 and 28 respectively.

Before molten aluminum 30 is placed into the tanks 14 to 18, the cooling bodies 23 are held raised as indicated in broken lines in FIG. 2.

The aluminum to be purified and containing both eutectic impurities and peritectic impurities is melted in the furnace 11, and the molten aluminum 30 is first placed into the vessel 14, in which boron is added to the melt 30. The mixture is agitated by the agitator 20. In this vessel 14, the boron reacts with Ti, V, Zr and like peritectic impurities, forming $TiB_2$, $VB_2$, $ZrB_2$ and like insoluble metallic borides. The molten aluminum containing the eutectic impurities, insoluble metallic borides and an excess of boron flows into the tanks 15 to 18 through the communication openings 19. After a predetermined amount of molten aluminum 30 has been placed into each of the tanks 15 to 18, the cooling body 23 is lowered and immersed in the melt, with the upper heat insulating member 27 in contact with the melt 30 and with the lower edge of the member 27 located within the mass of the melt 30 at such a position that it will not be influenced by the temperature of the atmosphere. The upper end peripheral portion of the body 23 is covered with the insulating member 27, and the body is so immersed in the melt 30 that the member 27 is in contact with the surface of the melt 30 with its lower edge at a position where it is free of the influence of the atmospheric temperature, for the following reason. The portion of the melt 30 near the surface thereof exposed to the atmosphere has a lower temperature than the other portion by being affected by the atmospheric temperature and is therefore liable to solidify on the periphery of the body 23 in the vicinity of the above surface. Consequently aluminum solidifies at a higher velocity at this portion than at the other portion of the periphery of the body 23, with the result that the aluminum fraction deposited on this portion has a lower purity than the fraction on the other portion and becomes mixed with the latter fraction when the purified aluminum is removed from the outer periphery of the body 23 for collection after the completion of the purifying operation. This results in a reduced overall purifying efficiency. Further the bottom of the cooling body 23 is covered with the heat insulating member 28 because the rotation of the body 23 will not produce a satisfactory effect at the bottom, such that the aluminum fraction deposited on the bottom of the body 23 has a lower purity than the other fraction on the periphery of the body.

Figure 5:
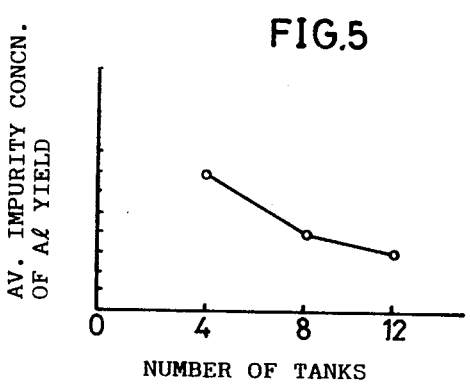
FIG. 5 is a graph showing the relation between the number of purifying tanks and the ratio of the eutectic impurity concentration of the aluminum obtained to that of the aluminum to be purified, the relation being determined by practicing the process of the invention with use of the second apparatus.
Figure 4:
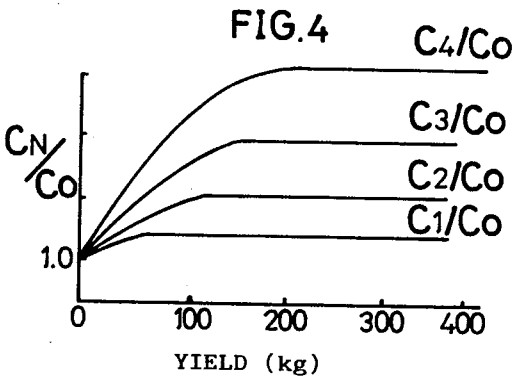
FIG. 4 is a graph showing the result achieved when the process of the invention was practiced with use of the second apparatus, the graph showing the relation of the amount of aluminum (yield) crystallized on the peripheral surface of a cooling body in each purifying tank to the ratio of the eutectic impurity concentration of the molten aluminum in the tank to the eutectic impurity concentration of the aluminum to be purified.

The cooling body 23 in this state is rotated while injecting a cooling fluid into the body through the inlets 25 of the supply pipe 26. This causes aluminum to crystallize on the portion of the peripheral surface of the body 23 which is immersed in the melt 30 and which is not covered with the insulating members 27 and 28. Since the metallic borides contained in the melt 30 are centrifugally forced away from the body 23 by the rotation thereof, the aluminum deposited on the periphery of the body 23 is free from such borides. The excess of boron, which forms a eutectic with aluminum, is removed like the eutectic impurities. The temperature of the molten aluminum, and the speed of rotation and cooling capacity of the bodies 23 are so controlled that equal amounts of aluminum will be deposited on the peripheral surfaces of the bodies in the purifying tanks 15 to 18, while the supply and discharge of molten aluminum are controlled so that the tanks 15 to 18 contain equal amounts of melt, with the recovery ratio maintained at a constant value. Assuming that the molten aluminum supplied from the furnace 11 has a eutectic impurity concentration of C0 and that the melt portions contained in the tanks 15 to 18 have eutectic impurity concentrations of C1, C2, C3 and C4 respectively, $C0<C1<C2<C3<C4$. Further the ratio of the eutectic impurity concentration of the melt in each of the tanks 15 to 18 to C0, namely the ratio CN/C0 where N is 1 to 4, increases with the start of the operation but levels off when the amount of aluminum deposit on the periphery of the cooling body 23 reaches a value as shown in FIG. 4. At this time, the total amount of eutectic impurities, Ms, in the aluminum recovered by the cooling bodies 23 plus the amount of eutectic impurities, Mn, in the molten aluminum discharged from the tank 18 at the right end is always equal to the amount of eutectic impurities, Mo, in the aluminum to be purified. Accordingly, if the eutectic impurity concentration and the effective distribution coefficient of the eutectic impurities of the molten aluminum in each of the tanks 15 to 18 are known, high-purity aluminum can be obtained with the desired eutectic impurity concentration when the recovery ratio is set to a definite value. The smaller the recovery ratio, the lower is the eutectic impurity concentration of the molten aluminum in each purifying tank, so that the cast block obtained has a higher purity. The purity of the aluminum to be obtained can be determined by varying the recovery ratio. At a definite recovery ratio, the eutectic impurity concentration of the molten aluminum discharged increases with the increase of the number of purifying tanks as seen in FIG. 5, enabling the cooling bodies 23 to afford aluminum of higher purity.

When the same operation as above is repeated again with use of the aluminum collected by the cooling bodies 23, aluminum having a higher purity can be obtained. Since the molten aluminum resulting from the second operation usually has a higher purity than the original aluminum used as the material for the first operation, the molten aluminum, if returned to the furnace 11, gives an improved yield.

EXAMPLE 1

Figure 1:
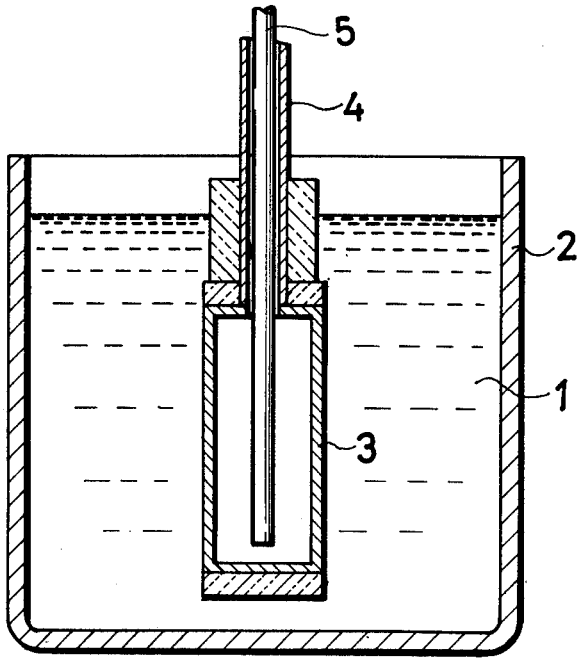
FIG. 1 is a view in vertical section showing a first embodiment of apparatus for producing high-purity aluminum by the process of the invention.

The apparatus shown in FIG. 1 was used. Aluminum containing 0.08 wt.% of Fe, 0.05 wt.% of Si, 0.0015 wt.% of Ti, 0.004 wt.% of V and 0.0005 wt.% of Zr was melted, and the molten aluminum 1 was maintained at 670° C. in the crucible 2. Al-3 wt.% B master alloy was added to the aluminum 1 so that the resulting melt had a boron concentration of 0.004 wt.%. The mixture was agitated for 5 minutes after the addition of the alloy. The cooling body 3, 100 mm in outside diameter, was immersed in the melt 1 and rotated at a speed of 400 r.p.m. while supplying air into the body 3 through the supply pipe 5. The body 3 was rotated for 10 minutes and thereafter withdrawn from the melt 1 by raising. The body 3 was found to have aluminum deposited on its periphery in an amount of 20 wt.% based on the amount of the original aluminum. When checked for impurity concentration, the cast aluminum block was found to contain 0.008 wt.% of Fe, 0.012 wt.% of Si, less than 0.0001 wt.% of Ti, 0.0002 wt.% of V, less than 0.0002 wt.% of Zr and 0.0003 wt.% of B.

EXAMPLE 2

The apparatus shown in FIG. 1 was also used. Aluminum containing 0.08 wt.% of Fe, 0.05 wt.% of Si, 0.002 wt.% of Ti, 0.008 wt.% of V and 0.001 wt.% of Zr was melted, and the molten aluminum 1 was maintained at 670° C. in the crucible 2. Al-3 wt.% B master alloy was added to the aluminum 1 so that the resulting melt had a boron concentration of 0.008 wt.%. The mixture was agitated for 5 minutes after the addition of the alloy. The cooling body 3, 200 mm in outside diameter, was then immersed in the melt 1 and rotated at a speed of 650 r.p.m. while supplying air into the body through the pipe 5. After rotating the body 3 for 10 minutes, the body 3 was withdrawn from the melt. The body 3 was found to have aluminum deposited on its periphery in an amount of 20% based on the amount of the original aluminum. When checked for impurity concentration, the cast aluminum block was found to contain 0.005 wt.% of Fe, 0.009 wt.% of Si, less than 0.0001 wt.% of Ti and V, less than 0.0002 wt.% of Zr and 0.0005 wt.% of B.

EXAMPLE 3

The apparatus shown in FIGS. 2 and 3 was used. The cooling bodies 23 were held raised. Aluminum containing 0.08 wt.% of Fe, 0.05 wt.% of Si, 0.002 wt.% of Ti and 0.008 wt.% of V was melted in the furnace 11, and the molten aluminum was supplied to the boron adding vessel 14. Boron was added to the aluminum so that the resulting melt had a boron concentration of 0.008 wt.% at all times. The mixture was agitated by the agitator 20. When the purifying tanks 15 to 18 were filled with the molten aluminum flowing through the communication openings 19, each cooling body 23 having a diameter of 200 mm at the portion thereof covered with the heat insulating member 27 was lowered into the molten aluminum 30. The body 23 was rotated at 400 r.p.m. while supplying a cooling fluid into its interior from the pipe 26. During operation, the molten aluminum was continuously supplied from the furnace 11 to the vessel 14 and tanks 15 to 18 so as to fill up these containers to a constant level. Boron was also continuously placed into the vessel 14 to maintain the boron concentration at 0.008 wt.% at all times. The eutectic impurity concentrations C1, C2, C3 and C4 of the melt portions in the tanks 15 to 18 remained in the relation of C1, C2, C3, C4 from the start of the operation, and a steady state was established after the amount of aluminum deposit on the body 23 reached a specified amount. When the effective distribution coefficient of iron was 0.1 at a recovery ratio of 0.7, the ratios of the iron concentrations C1, C2, C3 and C4 to the iron concentration C0 of the molten aluminum supplied from the furnace 11, namely C1/C0, C2/C0, C3/C0 and C4/C0, levelled off at 1.3, 1.6, 2 and 2.7, respectively. The operation was continued in this state. When checked for impurity concentration, the resulting cast aluminum blocks were found to contain 0.008 wt.% of Fe, 0.008 wt.% of Si, 0.0001 wt.% of Ti, 0.0002 wt.% of V and 0.0006 wt.% of B on the average.

EXAMPLE 4

The operation of Example 3 was repeated under the same conditions except that the recovery ratio was 0.4. The operation was continued in a steady state. All the aluminum blocks obtained were found to have average impurity concentrations of: 0.005 wt.% Fe, 0.006 wt.% Si, 0.0001 wt.% Ti, 0.0002 wt.% V and 0.0005 wt.% B.

EXAMPLE 5

The operation of Example 3 was repeated under the same conditions as in Example 3 except that eight purifying tanks were used in place of the four tanks. The operation was continued in a steady state. The aluminum blocks obtained were found to have the following average impurity concentrations: 0.0065 wt.% Fe, 0.007 wt.% Si, 0.0001 wt.% Ti, 0.0002 wt.% V, 0.0005 wt.% B. The aluminum had a higher purity than that obtained in Example 3 with use of the four purifying tanks and was produced at twice the speed therein.

The present invention may be embodied differently without departing from the spirit and basic features of the invention. Accordingly the embodiments herein disclosed are given for illustrative purposes only and are not in any way limitative. It is to be understood that the scope of the invention is defined by the appended claims rather than by the specification and that various alterations and modifications within the definition and scope of the claims are included in the claims.

What is claimed is:

1. A process for producing high-purity aluminum comprising the steps of melting the aluminum to be purified and containing both eutectic impurities and peritectic impurities to obtain molten aluminum, adding boron to the molten aluminum, and rotating a cooling body immersed in the boron-containing molten aluminum while introducing a cooling fluid to the interior of the cooling body; thereby, crystallizing high-purity aluminum having peritectic impurity concentration and eutectic impurity concentration lower than the original molten aluminum on the surface of the cooling body, and keeping the borides of peritectic impurities and the eutectic impurities away from the surface of the cooling body due to centrifugal force produced by the rotation of the cooling body.

2. A process for producing high-purity aluminum comprising the steps of melting the aluminum to be purified and containing both eutectic impurities and peritectic impurities to obtain molten aluminum, placing the molten aluminum into a holding container, adding boron to the molten aluminum within the container, and rotating a cooling body immersed in the boron-containing molten aluminum within the container while introducing a cooling fluid to the interior of the cooling body; thereby, crystallizing high-purity aluminum having a peritectic impurity concentration and eutectic impurity concentration lower than the original molten aluminum on the surface of the cooling body, and keeping the borides of peritectic impurities and the eutectic impurities away from the surface of the cooling body, due to centrifugal force produced by the rotation of the cooling body.

3. A process as defined in claim 2 wherein the molten aluminum is agitated after the boron is added thereto.

4. A process as defined in claim 2 or 3 wherein the speed of the relative movement between the cooling body and the molten aluminum is about 400 to about 8000 mm/sec when the cooling body is rotated.

5. A process for producing high-purity aluminum comprising melting the aluminum to be purified and containing both eutectic impurities and peritectic impurities to obtain molten aluminum, placing the molten aluminum into a boron adding vessel, causing the molten aluminum placed into the vessel to be forwarded to a plurality of purifying tanks from tank to tank and to be discharged from the tank, adding boron to the molten aluminum within the vessel, and rotating a cooling body as immersed in the boron-containing molten aluminum within each of the tanks while introducing a cooling fluid to the interior of the cooling body; thereby, crystallizing high-purity aluminum having a peritectic impurity concentration and eutectic impurity concentration lower than the original molten aluminum on the surface of the cooling body while keeping the borides of peritectic impurities and the eutectic impurities away from the surface of the cooling body due to centrifugal force produced by the rotation of the cooling body.

6. A process as defined in claim 5 wherein the molten aluminum having the boron added thereto in the vessel is agitated.

7. A process as defined in claim 5 or 6 wherein the speed of the relative movement between the cooling body and the molten aluminum is about 400 to about 8000 mm/sec when the cooling body is rotated.

8. A process as defined in claim 5 or 6 wherein the supply and the discharge of the molten aluminum are controlled so that the amounts of the molten aluminum in the purifying tanks remain unchanged during operation, and the cooling bodies are controlled so that equal amounts of high-purity aluminum are crystallized on the surfaces of the cooling bodies.

* * * * *